US007029361B2

(12) United States Patent
Seibert et al.

(10) Patent No.: US 7,029,361 B2
(45) Date of Patent: Apr. 18, 2006

(54) FINGER PUPPETS WITH SOUNDS

(75) Inventors: Amy M. Seibert, Dundee, IL (US); Ruth E. Synowic, Naperville, IL (US); Michael G. Gierek, Woodridge, IL (US); Thomas Tretter, Oak Park, IL (US); Kevin L. Taylor, Aurora, IL (US); Julie E. Yu, Carol Stream, IL (US)

(73) Assignee: The Marketing Store Worldwide, L.P., Lombard, IL (US)

( * ) Notice: Subject to any disclaimer, the term of this patent is extended or adjusted under 35 U.S.C. 154(b) by 148 days.

(21) Appl. No.: 10/659,688

(22) Filed: Sep. 9, 2003

(65) Prior Publication Data

US 2004/0121702 A1 Jun. 24, 2004

Related U.S. Application Data

(60) Provisional application No. 60/409,441, filed on Sep. 9, 2002.

(51) Int. Cl.
*A63H 3/14* (2006.01)

(52) U.S. Cl. ..... 446/327; 446/26; 446/297

(58) Field of Classification Search ..... 446/327, 446/366, 297–303, 175, 308–309, 311, 402, 446/26

See application file for complete search history.

(56) References Cited

U.S. PATENT DOCUMENTS 3,611,628 A * 10/1971 Noble et al. ..... 446/327
3,627,322 A * 12/1971 Leonhart ..... 446/366
3,763,591 A * 10/1973 Fontana ..... 446/366
4,173,842 A 11/1979 Bahner
4,280,292 A 7/1981 Hills
4,295,291 A * 10/1981 Fukui ..... 446/380
4,976,646 A 12/1990 Hull
5,342,234 A 8/1994 Bloom
D366,297 S 1/1996 Ford
5,498,189 A 3/1996 Townsend
5,540,132 A 7/1996 Hale
5,558,550 A 9/1996 Setteducati
5,820,440 A * 10/1998 Truchsess ..... 446/297
5,848,928 A 12/1998 Wong
5,989,091 A * 11/1999 Rodgers ..... 446/153
6,010,387 A 1/2000 Nemec et al.
6,057,501 A 5/2000 Hale
6,155,836 A 12/2000 Hancock
6,350,169 B1 2/2002 Holt
6,394,874 B1 5/2002 Kubo et al.
6,461,164 B1 10/2002 Ramelli
6,540,581 B1 4/2003 Kennedy
2002/0164921 A1* 11/2002 Wilkinson et al. ..... 446/308
2003/0162471 A1 8/2003 Gemma, Jr.
2003/0186198 A1 10/2003 Cubeta et al.
* cited by examiner

*Primary Examiner*—John A. Ricci
(74) *Attorney, Agent, or Firm*—Brinks Hofer Gilson & Lione

(57) ABSTRACT

A finger puppet toy sits comfortably on a finger of a child, and generates a sound when the finger is tapped against a hard object, such as a desk or a table-top. The sound may be a voice, an animal sound, an animal voice sound, a musical note, or any of the above sounds in the key of a musical note. The head of the puppet toy articulates about a shaft when the child articulates the finger, and the head may thus appear to move while the sound is generated. Multiple toys worn on one or more hands and having different musical notes may be tapped in sequence to play a melody.

28 Claims, 6 Drawing Sheets

FINGER PUPPETS WITH SOUNDS

This application claims the benefit of the filing date under 35 U.S.C. § 119(e) of Provisional U.S. Patent Application Ser. No. 60/409,441, filed on Sep. 9, 2002, which is hereby incorporated by reference in its entirety.

FIELD OF THE INVENTION

This invention generally relates to toys, and particularly to toys that can articulate and generate sounds.

BACKGROUND OF THE INVENTION

Children enjoy playing with toys. In particular, toy puppets may be used for a variety of games and amusements, as children can invent stories and act out the parts of the characters of the particular hand puppet they are playing with. In a group, if each child has a different puppet, each child may take on a different role and the group may act out any number of stories.

Finger puppets, i.e., small puppets that can be held on or by a finger, are useful in such play situations, especially when space is limited, such as a confined space, a small room or a limited portion of a larger room. In those situations, a child may easily slip a finger puppet onto a finger and act out a role.

Finger puppets could be more useful in play situations if they had more features and properties. For instance, U.S. Pat. No. 5,558,550 discloses a sound-generating simulated finger amusement device, but the device does not articulate, and is limited in its applicability for games and role-playing with young children. In another example, U.S. Pat. No. 6,394,874 discloses a sound-generating finger puppet, but the puppet articulates only about its base. This puppet does not allow for head or mouth movement, and is thus limited in "mouthing" the words from the child during his or her turn at play.

Puppets may also be used to acquaint children with the notes of the musical scale. U.S. Pat. No. 5,540,132 features a series of puppet characters, each of which is associated with a note of the musical scale. These characters, while potentially useful for teaching the notes of the musical scale, seem more appropriate for teaching/learning situations than for interactive playing and imaginative use. What is needed is a puppet that has more potential for stimulating play-acting for children using one or more of the puppets. What is needed is a puppet that can articulate and allow a child more opportunities for expression when playing with the puppet, or with a series of like puppets.

SUMMARY OF THE INVENTION

One embodiment of the invention is a toy for being held on or by a finger. The toy comprises a body having a top end and a bottom end, and means for mounting the toy on a finger, the means coupled to the body. The toy also comprises a computer chip and a speaker for generating at least one sound, the computer chip and the speaker mounted within the body. The toy includes a switch electrically connected to the computer chip and a finger tapper movably mounted to the bottom end of the body, wherein when the finger tapper is depressed, the switch is actuated to cause the generation of the sound.

Another embodiment of the invention is a toy for being held on or by a finger. The toy comprises a body comprising a front, a back, a top end and a bottom end, and means for mounting the toy on a finger. The toy further comprises a computer chip and a speaker for generating at least one sound, the computer chip and the speaker mounted in the body. The toy also comprises a switch electrically connected to the computer chip, and a finger tapper mounted on the bottom end of the body for actuation of the switch, wherein when the finger tapper is tapped, the switch is actuated to cause the generation of the sound.

Another embodiment of the invention is a method of assembling toys for being held on or by a finger. The method comprises providing a computer chip programmed to generate a sound, and assembling the computer chip inside a body of a finger puppet. The method also comprises installing a switch on the body and mounting a finger tapper near the switch, such that the finger tapper actuates the switch when tapped. Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 1:
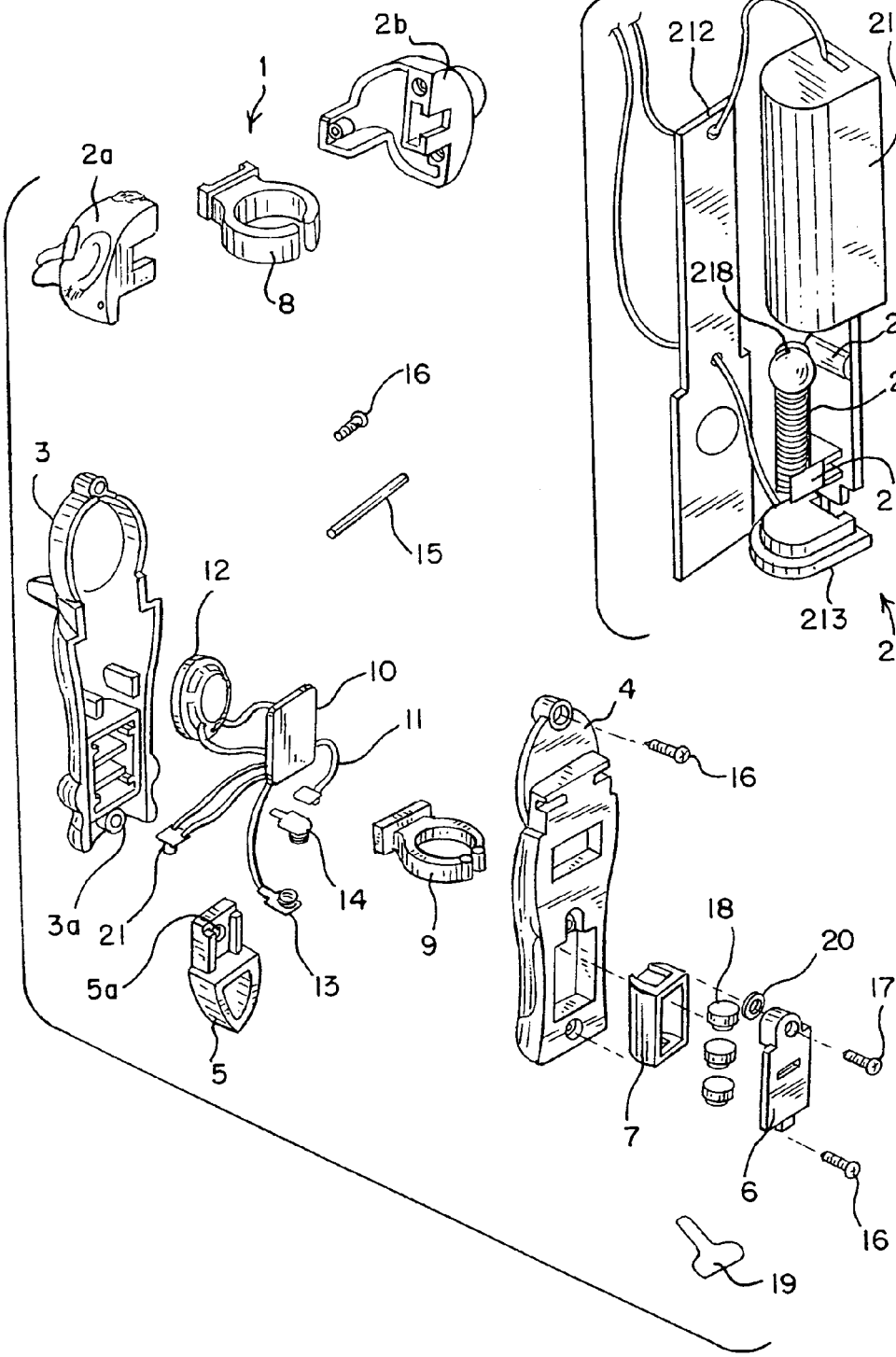
FIG. 1 is an exploded view of a finger puppet according to one embodiment.

FIG. 1 is an exploded view of a first embodiment of a finger puppet toy according to the present invention. The finger puppet 1 includes a left head portion 2*a* and a right head portion 2*b*. When assembled with screw 16, finger ring 8 is partly captured between the left head portion 2*a* and the right head portion 2*b*, in the slot provided in both the left and right head portions. The finger portion of the finger ring extends to the rear of the head. The puppet also includes a front body portion 3 and a rear body portion 4, joined with two screws 16 from the rear. When the head portions are assembled to the body portions, rod 15 is inserted through holes provided in the head portion and in the rear body portion 4, and is captured by features on the front body portion 3. The rod 15 allows the head portions to rotate slightly, so that the head appears to nod back and forth. This rotation may be considered an articulation, in that the head can move separately from the body. The head may also be considered to swivel on the axis of the rod, so that the head may be said to be articulably mounted to the body.

Other parts of the finger puppet toy include a second finger ring 9, mounted partially within the body, with the finger portion of the finger ring extending to the rear of the rear body portion 4. A computer chip 10 and a speaker 12 are also mounted within the body. The computer chip also has wiring 11 for connection to a source of power. A switch 21 is wired to the computer chip for activating the computer chip and enunciating a sound. Battery contacts 14, 15 are provided for connection to one or more batteries 18 to provide power for the computer chip and the speaker for enunciating the sound. The batteries may be housed separately in a small battery housing 7, secured with a battery housing door 6, and a screw 17 and washer 20. In order to preserve battery life after manufacture and before use, insulation 19 may be provided between the positive contact 14 and the batteries. The insulation may be removed by the customer after purchase.

The computer chip with a preprogrammed sound byte is activated by switch 21 when the finger tapper 5 is tapped onto a hard surface, such as a tabletop or a floor. As used herein, a finger tapper is a relatively hard object that fits snugly onto the bottom of the finger puppet, and is capable transmitting a force from a tabletop or other hard surface to a touch switch 21, or other switch used in the puppet. The finger tapper is mounted through an opening 5*a* in the finger tapper 5 onto a protrusion 3*a* in the front body portion 3. The protrusion 3*a* is captured by a mating feature in the rear body portion 4. The finger tapper opening 5*a* is slightly elongated vertically. The finger tapper 5 fits snugly onto protrusion 3*a*, so that it requires the small effort exerted by the tap of a finger to move the finger tapper 5 vertically to contact switch 21. The switch 21 is preferably a pressure or touch switch, and the preferred embodiment of the puppet requires the finger tapper to move about one-sixteenth of an inch (about 0.0625 inches, or about 1.5 mm) to activate the voice computer chip. The computer chip is a voice integrated circuit. Such circuits are commercially available, and may be programmed for up to 3 seconds of a sound, or up to 6 seconds, or other interval. One to three seconds is preferred in order to conserve battery life and to provide a speedy play environment.

The finger puppet toy fits onto the finger of a child through the rings that protrude from the rear of the puppet. The puppet may be "worn" as desired, but one way to "wear" the puppet is to place the puppet so that the lower ring is approximately at the most distal joint of the finger, and the upper ring is relatively near the knuckle of the wearer's hand. Flexing the finger then causes a slight rotation of the head of the puppet about the rod that supports and allows the rotation. By timing the tapping of a finger, and the sound that is emitted from the puppet, with the bending of the finger, the puppet will appear to mouth whatever sound has been programmed into the chip. It is not necessary to use two finger rings to mount the puppet onto the finger, although articulation may be difficult without using two finger rings. It is also not necessary for the puppet to have an articulable head, although this feature certainly adds to the fun of having and playing with the puppet toy.

Figure 3A:
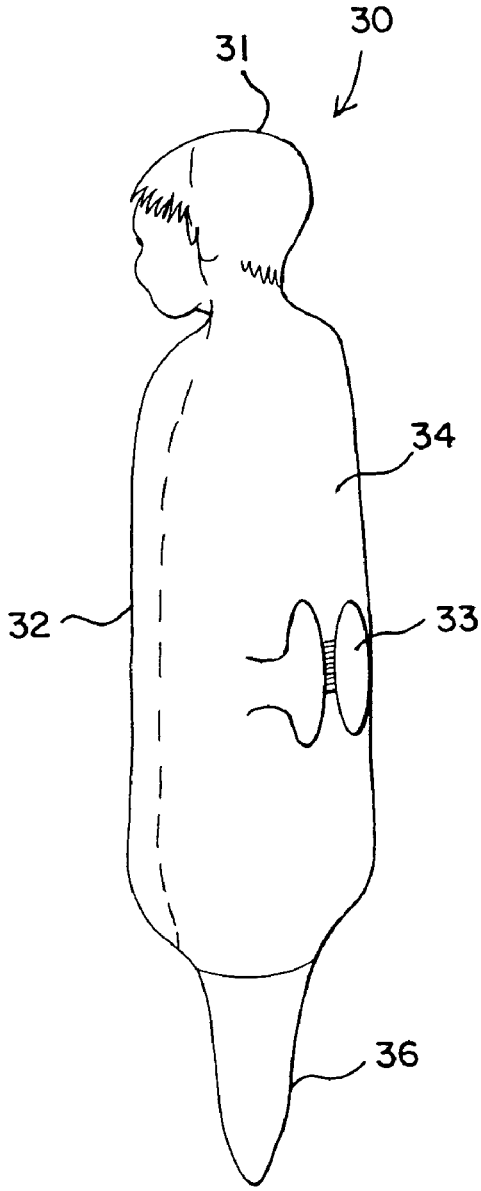
FIGS. 3*a* and 3*b* are rear perspective views of alternative embodiments of finger puppets.

Some embodiments feature a puppet toy having only a single ring and having a head that is not articulable, that is, a head that is molded with the body. FIG. 3*a* depicts a rear perspective view of a finger puppet 30 having only one ring 33. The puppet is made from a front half 32 and a back half 34 which includes integrally-molded front and back portions, respectively, of the head 31 of the puppet. Therefore, the head of the puppet cannot rotate, or swivel, as shown in the embodiment of FIG. 1. The puppet 30 has all the other internal parts, including the computer chip with preprogrammed sound byte and speaker. The puppet also has a finger tapper 36, so that when a child taps the puppet on a hard surface, the preprogrammed sound is emitted from the puppet.

Figure 3B:
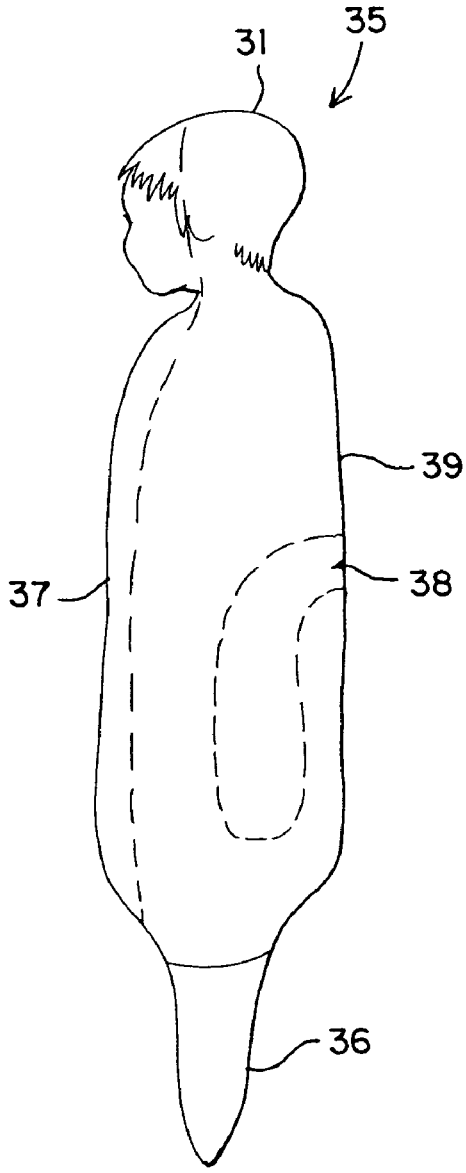

FIG. 3*b* depicts another embodiment 35 of a toy that has no ring but instead a cavity 38 into which a child may insert a finger. The toy of FIG. 3*b* also has a front half 37 and a back half 39, including the head 31 of the toy. The back half has an opening to a cavity 38 so that a child may mount the toy on a finger. The finger tapper 36 allows the child to tap the toy and generate one or more sounds, according to the programming of the internal chip.

The finger puppets may be molded as characters that children can identify with or enjoy associating themselves with. These characters may include, for example, animals, imaginary animals, cartoon characters, animals or characters associated with television and motion pictures, and characters from life. An animal image for a finger puppet may include, but is not limited to, a lion or lion cub, a tiger, a cheetah, a leopard, a panther, a hyena, a bird, a mouse, a cricket, a chicken, a duck, a goose, a rabbit, an insect, a cow, a pig, a warthog, a cat, a dog, a monkey, a baboon, a bear, a wolf, a snake, an octopus, a dolphin, an elephant and a giraffe. Anthropomorphic "animals" may also be included, i.e., animals that have a human-like character in their behavior or speech.

A puppet toy in the shape of a cartoon character may include a character seen in television or in a motion picture. Such a puppet may be molded in the form of a ghost, a pirate, a burglar, a government official, a licensed character, and the like. A finger puppet embodiment may assume any character having an attraction for children. It is preferred, however, that the puppet retains a vertical aspect that may be reasonably replicated in a finger puppet having an elongated aspect ratio. That is, the finger puppets are considerably longer than they are wide, in the general shape of a finger, which is longer than it is wide. Thus, multiple puppets may fit side-by-side, attached to multiple fingers on the same hand.

The sounds of the finger puppet toy are preferably short, up to about 3 seconds in length. Keeping the sound short helps to conserve battery power and also adds a speed aspect to the puppets. Because the sound byte is short, it requires rapid activity to repeat the sound or sounds. The sound that is recorded and programmed into the chip may be selected from a great variety of sounds. The sound may be of a type selected from an animal sound, a musical sound, a musical note, a musical animal sound, a voice sound, an animal voice sound, and a musical animal voice sound. For example, each of the animals listed above may have an animal sound associated with the animal: a growl for a lion, a snort or grunt from a pig, a squawk from a bird, a bark from a dog, and so on. In a preferred embodiment, only a single sound is programmed into each puppet. Other embodiments may use more than one sound, and may alternate the sound that is emitted.

A puppet toy may also take on a sound different from the above sounds, and each puppet associated with a group may take on a sound such that the group has a tune or motif. For instance, a single puppet may be programmed with the musical note "C." A group of puppets may include three puppets, one programmed for the musical note "A," a second with "B," and the third with "C." A group of finger puppets may include eight puppets, a single note, from "A" through "G" and high "A", or middle "C" to high "C," programmed into each puppet. A series of eight puppets may thus include an octave of notes in a single key. A child could mount four puppets onto each hand, thus hold all eight puppets at once. By tapping one puppet at a time onto a tabletop or other hard surface, it is possible to play a simple tune. Of course, a simple tune may also be sounded with fewer than eight different notes, and thus fewer than eight puppet toys.

In addition to animal sounds and musical sounds, other sounds may be used in puppets. These other sounds may include variations on both, such as an animal sound in a higher or lower pitch. For instance, a puppet in the form of a lion cub may have a "growl" at a higher pitch or frequency, than a puppet in the form of an adult lion. By using a series of sounds or notes, one to a puppet, a tune or motif may be realized. For instance, a trio of puppets in the form of three fairies may each have a sound that differs in pitch. A trio of puppets in the form of The Three Bears (adult male, adult female, child) may have similar growls or exclamations, differing in pitch. Many other sounds or tunes using sounds may be used. In one embodiment of the invention, up to eight different sounds (on eight puppets) may be used.

Figure 6:
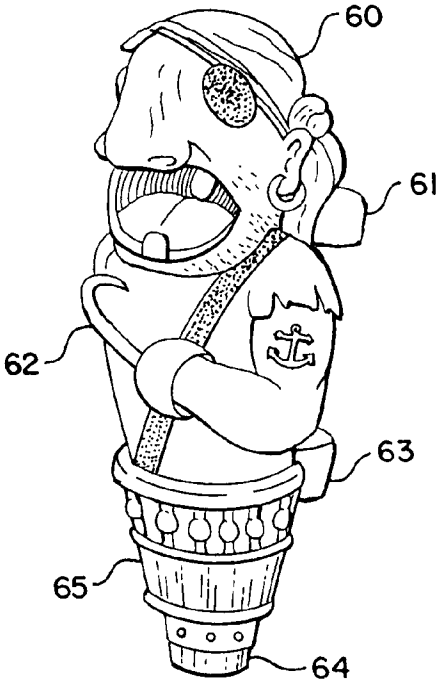
FIGS. 4–6 are front perspective views of three embodiments of finger puppets.
Figure 5:
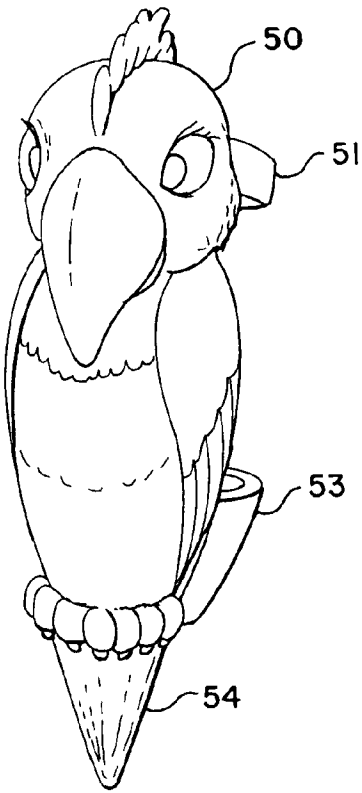
Figure 4:
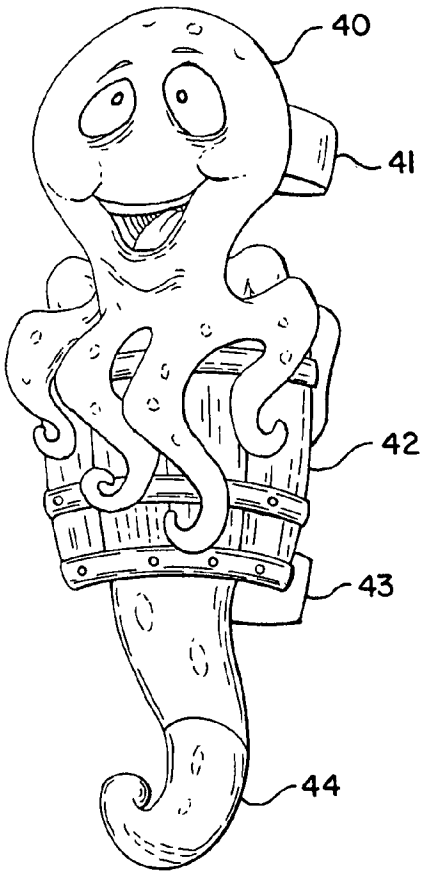

FIGS. 4–6 three different character embodiments of finger puppet toys according to the present invention. FIG. 4 features an octopus 40 atop a barrel 42. The upper finger ring 41 and the lower finger ring 43 are visible, and the finger tapper 44 is disguised. FIG. 5 features a parrot 50 with an upper ring 51 and lower hollow cone 53 (instead of a lower finger ring) for inserting a finger, and a finger tapper 54. FIG. 6 features a pirate 60 with a hook 62 for a hand, the pirate mounted in a crow's nest 65 which doubles as a finger tapper 64. Also visible are the upper and lower finger rings 61, 63. Taken together, the three finger puppets may suggest a nautical or pirate theme. A theme in this sense means that the toys have a common subject or thread of interest tying the toys together. Other combinations of finger puppets may suggest other themes, such as barnyard animals, jungle animals, storybook characters, and nursery characters. Examples include Goldilocks and the Three Bears, and the Three Little Pigs. The themes may be found in the visual representation of the characters or in the audible sounds.

Figure 7:
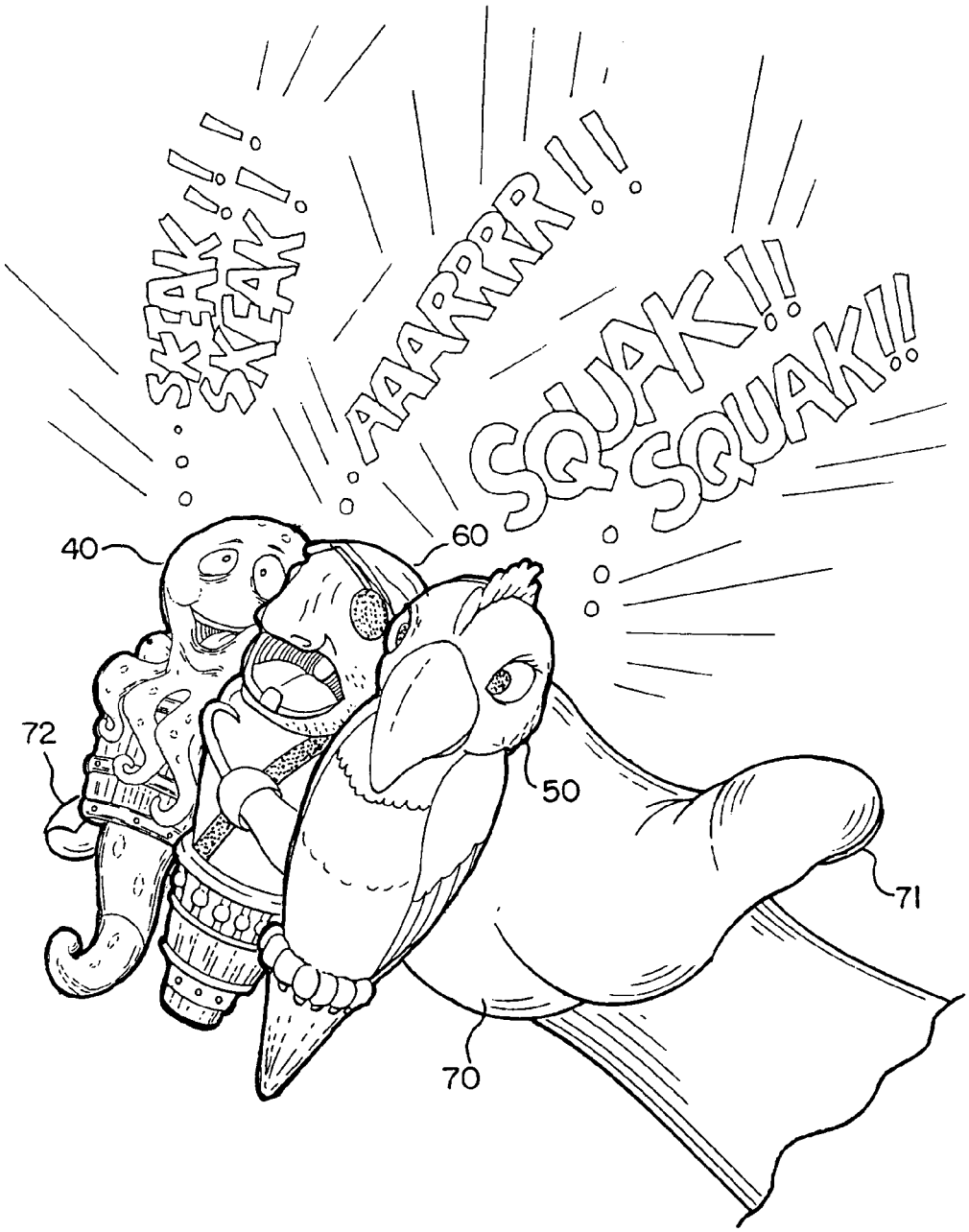
FIG. 7 is a front perspective view of the three embodiments of finger puppets of FIGS. 4–6 worn on the hand of a child.

FIG. 7 suggests one playful use of the three puppets featured in FIGS. 4–6. The three puppets, 40, 50, 60 are mounted on fingers (not visible) of a child's hand 70, with the thumb 71 and little finger 72 free for other uses. In other situations, the child may use a fourth puppet, on the little finger, and may use both hands, to play with up to eight puppets at once.

Figure 2:
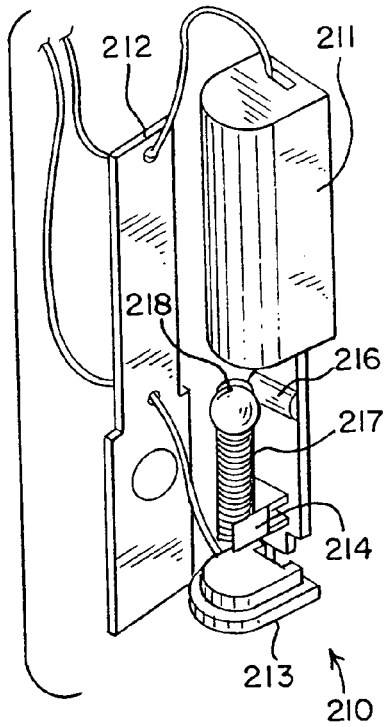
FIG. 2 is a partially exploded view of an inertia switch useful in the present invention.

There are many ways to practice the invention. For instance, instead of a touch switch as depicted in FIG. 1, an inertia switch may be used with the finger tapper. An inertia switch is depicted in FIG. 2. An inertia switch, also known as a spring or motion switch, depends on a sudden change of motion to activate the switch. FIG. 2 depicts such an inertia or spring switch 210. The inertia switch is mounted vertically, as shown, and includes a housing 211, cover plate 212 and end plate 213, preferably all made from non-conductive material, such as plastic. Two wires make contact with first contact 214 and second contact 216 and the wires are preferably soldered to the contacts. A spring 217 and preferably a mass or weight 218 occupy space between the contacts. The spring is preferably metallic or at least conductive. First contact 214 is preferably soldered to spring 217. The weight 218 is preferably non-conductive, or at least covered with an insulative material.

When the child wearing the puppet toy taps the finger tapper, the weight causes the spring to move downward and then back upward. The end of the spring then contacts second contact 216 momentarily, and the switch is closed for that moment. This has the same effect as a touch switch on the integrated circuit that controls the puppet, and causes the sound programmed into the puppet to be sounded. The inertia switch 210 may be somewhat taller than a touch switch, and it may require more space. Inertia switch 210 is shown greatly enlarged in FIG. 2. Note that it is not necessary for the finger tapper to move with respect to the switch when an inertia or spring switch is used. The tap, or sudden change in speed, causes the inertia switch to activate, rather than the motion of the finger tapper depressing a contact, as in a touch or pressure switch.

Figure 8:
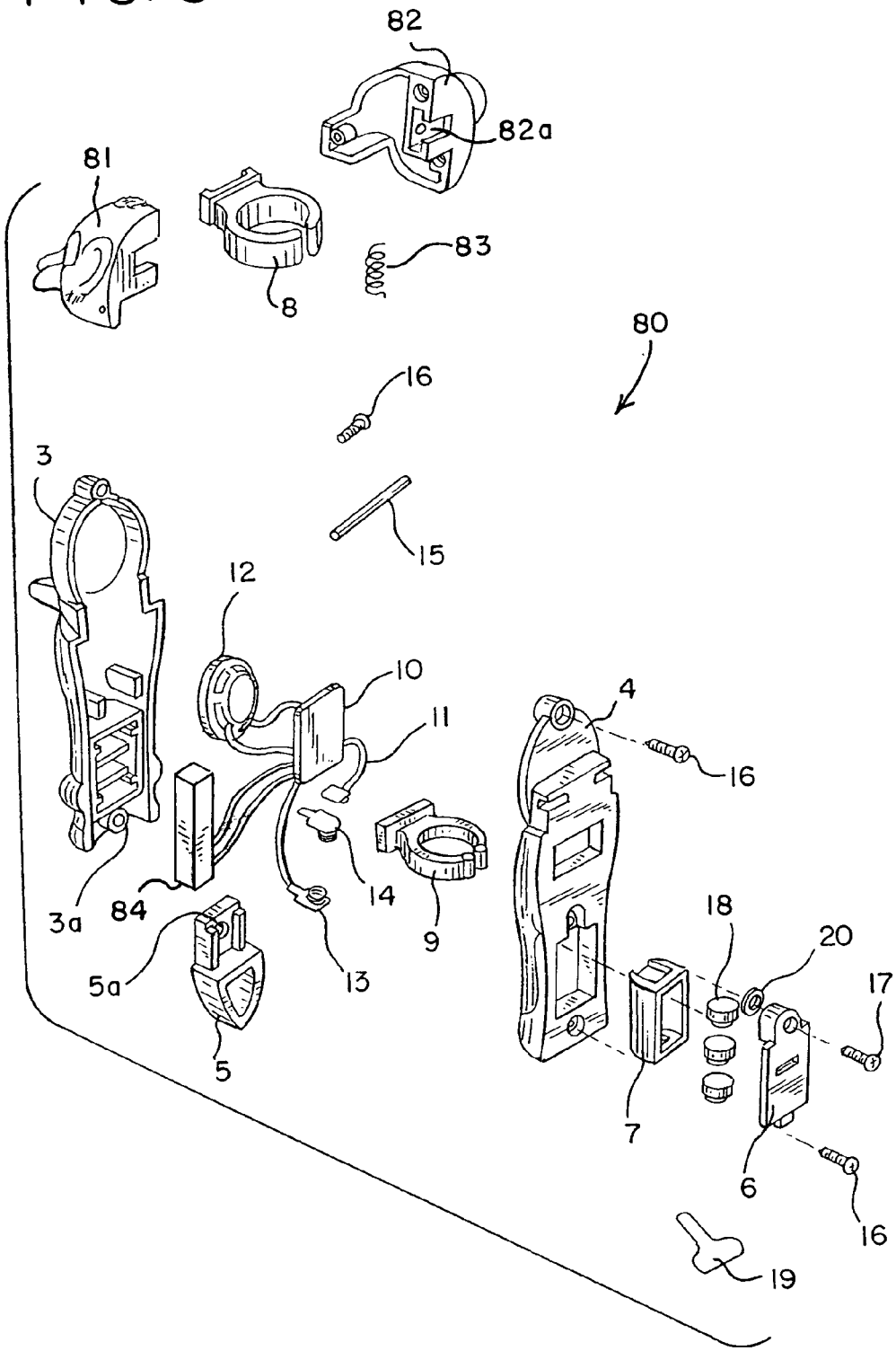
FIG. 8 is an exploded view of another embodiment of a toy for being held on a finger, illustrating a spring to activate the spring switch when the head is articulated.
Figure 9:
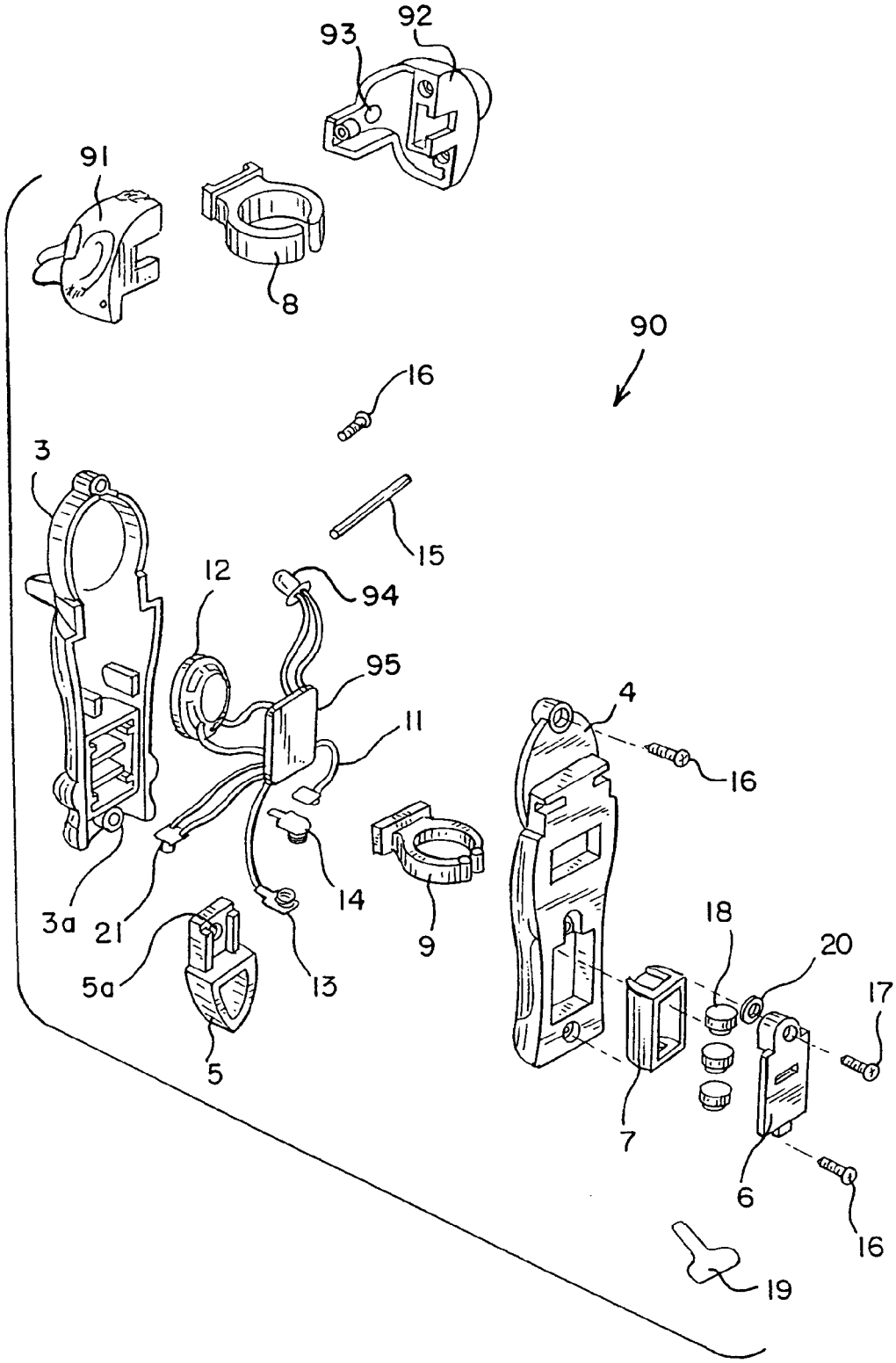
FIG. 9 is an exploded view of another embodiment of a toy, having both a sound and a lighting capability.

Other embodiments of the invention are depicted in FIGS. 8 and 9, both figures having in common many parts from FIG. 1. Only those portions of the toys that are different from FIG. 1 will be discussed. FIG. 8 features a finger toy 80 in which a sound is generated when the head is articulated. In FIG. 8, there is a spring 83, anchored to right head portion 82 and left head portion 81 by means of an aperture 82*a* in at least one of the head portions. The spring is also anchored to the inertia or motion switch 84, so that when the head portions are articulated, the spring will cause motion in inertia switch 84 and the toy will generate a sound. It is also possible to design the toy so that an extra spring 84 is not required to activate the inertia switch upon articulation. For instance, the inertia switch may have a relatively weak spring inside, so that only a small motion will activate the switch.

FIG. 9 depicts an exploded view of an embodiment of a finger toy 90 having both sound and flashing light capabilities. In FIG. 9, there are left and right head portions, 91, 92 at least one of the head portions configured to support a light-emitting diode (LED) 94, which will cause the toy to flash a light. In FIG. 9, there is a programmed chip 95, programmed for at least one sound and also at least one sequence or timing pattern for flashing LED 94, which will be visible outside the toy. The LED in FIG. 9 may be positioned so that the LED itself is mounted in aperture 93, near the nose of the finger toy. The flashing pattern may be a timed interval or a random pattern, or may simply flash the LED for a second or two whenever the pressure or touch switch 21 is activated. Other embodiments may use a motion switch.

The puppets may be made from a number of materials. Plastics that are temperature stable and easily colored are preferred, such as acrylonitrile-butadiene-styrene (ABS). ABS is relatively hard, and is very useful for the body and the head of the puppets, as well as the finger tapper. Other materials may be used, such as polyethylene for hard-bodied or softer-bodied finger puppets, or polypropylene for soft-bodied finger puppets. Besides plastics, cloth materials may be used in addition to or in place of plastics, such as polyester tricot, velour, velour velboa, velvet, and crushed velvet.

It is preferable to use a flexible plastic for the finger rings. Polyethylene and polypropylene are preferred. Any number of standard batteries may be used to power the puppet. Standard alkaline button cell batteries are preferred, and an AG3 battery, 1.5 volts fresh, is most preferred. The batteries may be placed in series, to achieve 3 volts, 4.5 volts, or other voltages as desired. Three batteries in series is a preferred configuration. Computer chips for controlling the sounds or lights of the finger puppets are available from many sources, include Mosway, Ltd., in Hong Kong.

Various embodiments of the invention have been described and illustrated. However, the description and illustrations are by way of example only. Other embodiments and implementations are possible within the scope of this invention and will be apparent to those of ordinary skill in the art. For instance, some embodiments of the finger puppets have been described and claimed as comprising a body having a front portion and a back portion. Such pieces may also be molded as left and right portions, with the internal parts captured therebetween during assembly. Construction from a front and a rear is preferably at least aesthetically, and may be preferable from a functional point, but the puppet will also work if the body is made from a left and a right half. Therefore, the invention is not limited to the specific details, representative embodiments, and illustrated examples in this description. Accordingly, the invention is not to be restricted except in light as necessitated by the accompanying claims and their equivalents.

What is claimed is:

1. A toy for being held on or by a finger, comprising:

a body having a top end and a bottom end defining a vertical axis therebetween;

means for mounting the toy in an upright, vertical orientation on a finger, the means coupled to the body;

a computer chip and a speaker for generating at least one sound, the computer chip and the speaker mounted within the body;

a switch electrically connected to the computer chip, said switch requiring motion along the vertical axis for actuation of the switch; and a finger tapper mounted on and extending away from the bottom end of the body, said finger tapper movable relative to the body in a direction along the vertical axis for momentary contact with the switch, such that when the finger tapper is depressed, the switch is actuated by the finger tapper to cause the generation of the sound.

2. The toy of claim 1, wherein the body further comprises a front and a back, and the means for mounting comprises a ring assembled between the front and the back, and protruding through the back.

3. The toy of claim 2, wherein the toy further comprises a shaft mounted at the top end of the body and further comprising a head part articulably mounted to the shaft.

4. The toy of claim 3, wherein the motion switch is connected to the head part, and wherein the motion switch is actuated to cause the generation of the sound when the head articulates or when the finger tapper is depressed.

5. The toy of claim 1, wherein the sound lasts about one to three seconds.

6. A plurality of toys according to claim 1, wherein each of the plurality of toys generates a different sound or the same sound.

7. A plurality of toys according to claim 6, wherein each of the toys has a different sound and the different sounds comprise a tune.

8. A group of at least three toys according to claim 1, wherein each of the toys is different and the group further comprises a theme.

9. A group of eight toys according to claim 1, wherein each of the toys generates a different sound and the eight sounds comprise an octave.

10. The toy of claim 1, further comprising at least one LED connected to the computer chip, wherein the computer chip further comprises a routine for flashing at least one pattern for the at least one LED.

11. A toy for being held on or by a finger, comprising:

a body comprising a front, a back, a top end and a bottom end, the top and bottom ends defining a vertical axis therebetween;

means for mounting the toy on a finger in a vertical orientation;

a computer chip and a speaker for generating at least one sound, the computer chip and the speaker mounted in the body;

a switch electrically connected to the computer chip, said switch mounted on the toy along the vertical axis for actuation of the switch; and a finger tapper mounted on the bottom end of the body, said finger tapper extending away from the body in a direction along the vertical axis, wherein when the finger tapper is tapped against an object, the switch is actuated to cause the generation of the sound.

12. The toy of claim 11, further comprising a battery operably connected to the computer chip and the speaker.

13. The toy of claim 11, wherein at least the front of the toy is configured in the shape of an animal or a character.

14. The toy of claim 11, wherein the sound is of a type selected from the group consisting of an animal sound, a musical sound, a musical note, a musical animal sound, a voice sound, an animal voice sound, and a musical animal voice sound.

15. The toy of claim 11, further comprising a shaft mounted at the top end of the body and further comprising a head articulably mounted via a shaft to the front and back portions.

16. The toy of claim 15, wherein the switch is an inertia switch and an end of the inertia switch is connected to the head, wherein the inertia switch is actuated to cause the generation of the sound when the head articulates or when the finger tapper is tapped against an object.

17. The toy of claim 11, wherein the means for mounting comprises two rings, a first ring mounted to the head and a second ring mounted between the front and back portions.

18. A toy of claim 11, wherein the switch is selected from the group consisting of a touch switch and an inertia switch.

19. A toy of claim 11, further comprising at least one LED connected to the computer chip, wherein the computer chip further comprises a routine for flashing at least one pattern for the at least one LED.

20. A combination of a plurality of toys according to claim 11, wherein each of the toys generates a different sound and the plurality of sounds comprise a tune.

21. A combination according to claim 11, wherein each of the toys is different and the combination further comprises a theme.

22. A combination of eight toys according to claim 11, wherein each of the toys generates a different sound and the eight sounds comprise an octave.

23. A method of assembling toys for being held on or by a finger in a vertical orientation, the method comprising:

providing a computer chip programmed to generate a sound;

enclosing the computer chip inside a body of a finger puppet;

installing a switch on the body, such that said switch is mounted for requiring motion in a vertical direction for actuation of the switch; and mounting a finger tapper extending away from the body in the vertical direction near the switch.

24. The method of claim 23, further comprising mounting a head articulably to the body.

25. The method of claim 23, further comprising mounting at least one finger ring to at least one of the body and the head, wherein the at least one ring protrudes from the rear of the body.

26. The method of claim 23, wherein the sound is selected from the group consisting of an animal sound, a musical sound, a musical note, a musical animal sound, a voice sound, an animal voice sound, and a musical animal voice sound.

27. The method of claim 23, further comprising installing at least one battery in electrical contact with the computer chip.

28. The method of claim 23, mounting at least one LED onto the body.

* * * * *

UNITED STATES PATENT AND TRADEMARK OFFICE

CERTIFICATE OF CORRECTION

PATENT NO. : 7,029,361 B2
APPLICATION NO. : 10/659688
DATED : April 18, 2006
INVENTOR(S) : Amy M. Seibert et al.

It is certified that error appears in the above-identified patent and that said Letters Patent is hereby corrected as shown below:

Column 7, in claim 2, line 3, immediately after "front and the back" delete "," (comma).

Signed and Sealed this

Twentieth Day of March, 2007

JON W. DUDAS
*Director of the United States Patent and Trademark Office*